US006450489B1

(12) United States Patent
Wang

(10) Patent No.: US 6,450,489 B1
(45) Date of Patent: Sep. 17, 2002

(54) WORK CLAMP FOR WOODWORKING MACHINES

(76) Inventor: Ching-Shu Wang, No.5 Alley 5 Lane 178 Chang-Chun Rd., Tai-Chung Hsien (TW)

( * ) Notice: Subject to any disclaimer, the term of this patent is extended or adjusted under 35 U.S.C. 154(b) by 0 days.

(21) Appl. No.: 09/802,816

(22) Filed: Mar. 12, 2001

(51) Int. Cl.[7] ..... B25B 5/02
(52) U.S. Cl. ..... 269/6; 269/171.5
(58) Field of Search ..... 269/6, 3, 228, 269/166–171.5, 203, 209, 197–199; 81/987

(56) References Cited

U.S. PATENT DOCUMENTS 4,336,927 A * 6/1982 Goff et al. ..... 269/171.5
5,499,800 A * 3/1996 Albin ..... 269/6
5,853,168 A * 12/1998 Drake ..... 269/6
6,254,073 B1 * 7/2001 Noniewicz et al. ..... 269/6

* cited by examiner

*Primary Examiner*—Robert C. Watson
(74) *Attorney, Agent, or Firm*—Charles E. Baxley

(57) ABSTRACT

A work clamp for wood-working machines, includes a guide bar, a fixed clamping plate fixedly mounted on the guide bar, a movable clamping plate slidably mounted on the guide bar and moved relative to the fixed clamping plate to hold down workpiece with the fixed clamping plate, and a control device adapted to control movement of the movable clamping plate on the guide bar relative to the fixed clamping plate and to lock the movable clamping plate in the desired position.

8 Claims, 4 Drawing Sheets

WORK CLAMP FOR WOODWORKING MACHINES

BACKGROUND OF THE INVENTION

The present invention relates to woodworking machines and, more particularly, to a work clamp for use in a woodworking machine to hold down the workpiece for cutting.

In order to cut a number of wooden materials at a time, a work clamp is necessary to hold down wooden materials on the table of the woodworking machine. A satisfactory work clamp for this purpose shall have the advantages of compact structure, high workpiece clamping power, ease of use, less table space occupation.

SUMMARY OF THE INVENTION

It is one object of the present invention to provide a work clamp for woodworking machines, which is easy to operate. It is another object of the present invention to provide a work clamp for woodworking machines, which positively holds down the workpiece for processing when locked. It is still another object of the present invention to provide a work clamp for wood-working machines, which is compact and, requires less installation space To achieve these and other objects of the present invention, the work clamp comprises a guide bar; a fixed clamping plate fixedly fastened to the guide bar, the fixed clamping plate having a clamping face disposed at a bottom side thereof; a movable clamping plate mounted on the guide bar and driven to move along the guide bar relative to the fixed clamping plate, the movable clamping plate having a clamping face disposed at a bottom side thereof and facing the clamping face of the fixed clamping plate for clamping workpiece between the fixed clamping plate and the movable clamping plate; and a control device adapted to lock the movable clamping plate and to control movement of the movable clamping plate on the guide bar relative to the fixed clamping plate to further adjust the pitch between the clamping face of the fixed clamping plate and the clamping plate of the movable clamping plate.

DETAILED DESCRIPTION OF THE PREFERRED EMBODIMENT

Figure 1:
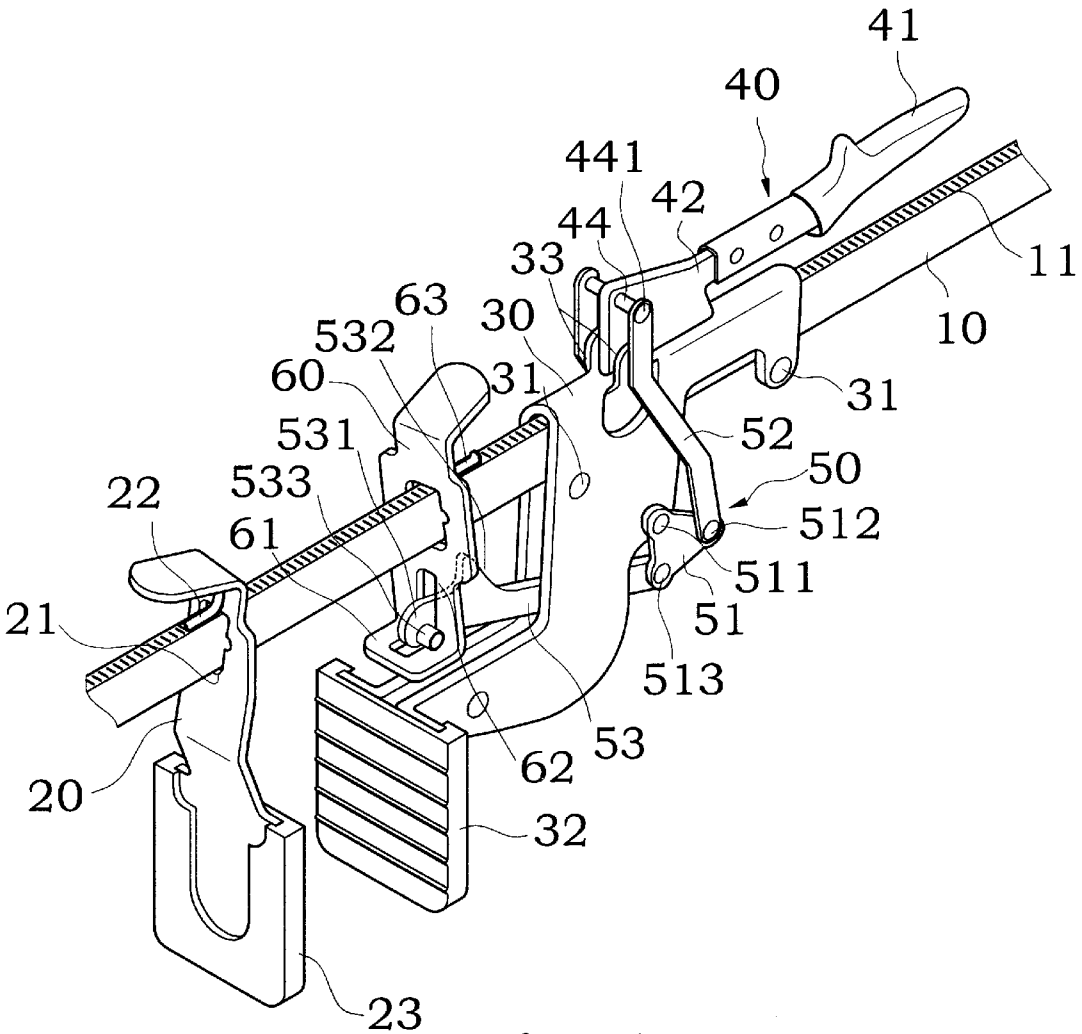
FIG. 1 is a perspective view of a work clamp constructed according to the present invention.

Referring to FIG. 1, a work clamp is shown comprising a guide bar 10, a fixed clamping plate 20 fastened to the guide bar 10, a movable clamping plate 30 moved on the guide bar 10 relative to the fixed clamping plate 20, and a control device adapted to control positioning or movement of the movable clamping plate 30 on the guide bar 10.

The guide bar 10 has a fine-toothed face 11 longitudinally disposed at the top side thereof to increase its surface friction force. The fixed clamping plate 20 comprises a through hole

21 fitting the diameter of the guide bar 10, a press tongue 22 obliquely downwardly extended from a top side of the periphery of the through hole 21 and stopped against the fine-toothed face 11 of the guide bar 10 to hold the fixed clamping plate 20 on the guide bar 10 in position, and a downwardly extended clamping face 23 disposed at the bottom side thereof. The movable clamping plate 30 has a substantially Π-shaped profile suspended from and driven to move along the guide bar 10, comprising a plurality of locating elements 31 disposed at the bottom side of the guide bar 10 and adapted to guide movement of the movable clamping plate 30 along the guide bar 10 in horizontal direction, a downwardly extended clamping face 32 disposed at the bottom side thereof corresponding to the clamping face 23 of the fixed clamp plate 20, and two upright lugs 33 arranged in parallel at the top side thereof. The aforesaid control device is comprised of a handle 40, a linkage 50, and a stop plate 60. The handle 40 has one end terminating in a handgrip 41, and the other end terminating in a blade 42. The blade 42 has a front lower corner pivoted to the lugs 33 of the movable clamping plate 30 by a pivot pin 43, and a front upper corner provided with pivot 44. The linkage 50 is comprised of two triangular coupling plates 51, two first links 52, and a second link 53. The triangular coupling plates 51 each have a first angle pivoted to the movable clamping plate 30 by a first pivot 511, a second angle provided with a second pivot 512, and a third angle provided with a third pivot 513. The first links 52 each have a first end pivoted to the second pivot 512 of each of the triangular coupling plates 51, and a second end pivoted to the pivot 44 at the front upper corner of the blade 42 of the handle 40. The second link 53 is inserted through the inside space of the movable clamping plate 30 having a first end respectively pivoted to the third pivot 513 of each of the triangular coupling plates 51, and a second end terminating in a first fork 531 and a second fork 532. The stop plate 60 is sleeved onto the guide bar 10 (the stop plate 60 has an opening for the passing of the guide bar 10) and disposed between the fixed clamping plate 20 and the movable clamping plate 30, having an angled bottom coupling flange 61 coupled to the first fork 531 of the second link 53, and a press tongue 63 obliquely downwardly disposed at the top and stopped against the fine-toothed face 11 of the guide bar 10 to hold the stop plate 60 on the guide bar 10 in position. The angled bottom coupling flange 61 has a through hole 62. The first fork 531 of the second link 53 is inserted through the through hole 62 of the angled bottom coupling flange 61. After insertion of the first fork 531 of the second link 53 through the through hole 62 of the angled bottom coupling flange 61, a transverse stop rod 533 is fastened to the first fork 531 to secure the second link 53 to the stop plate 60.

Figure 2:
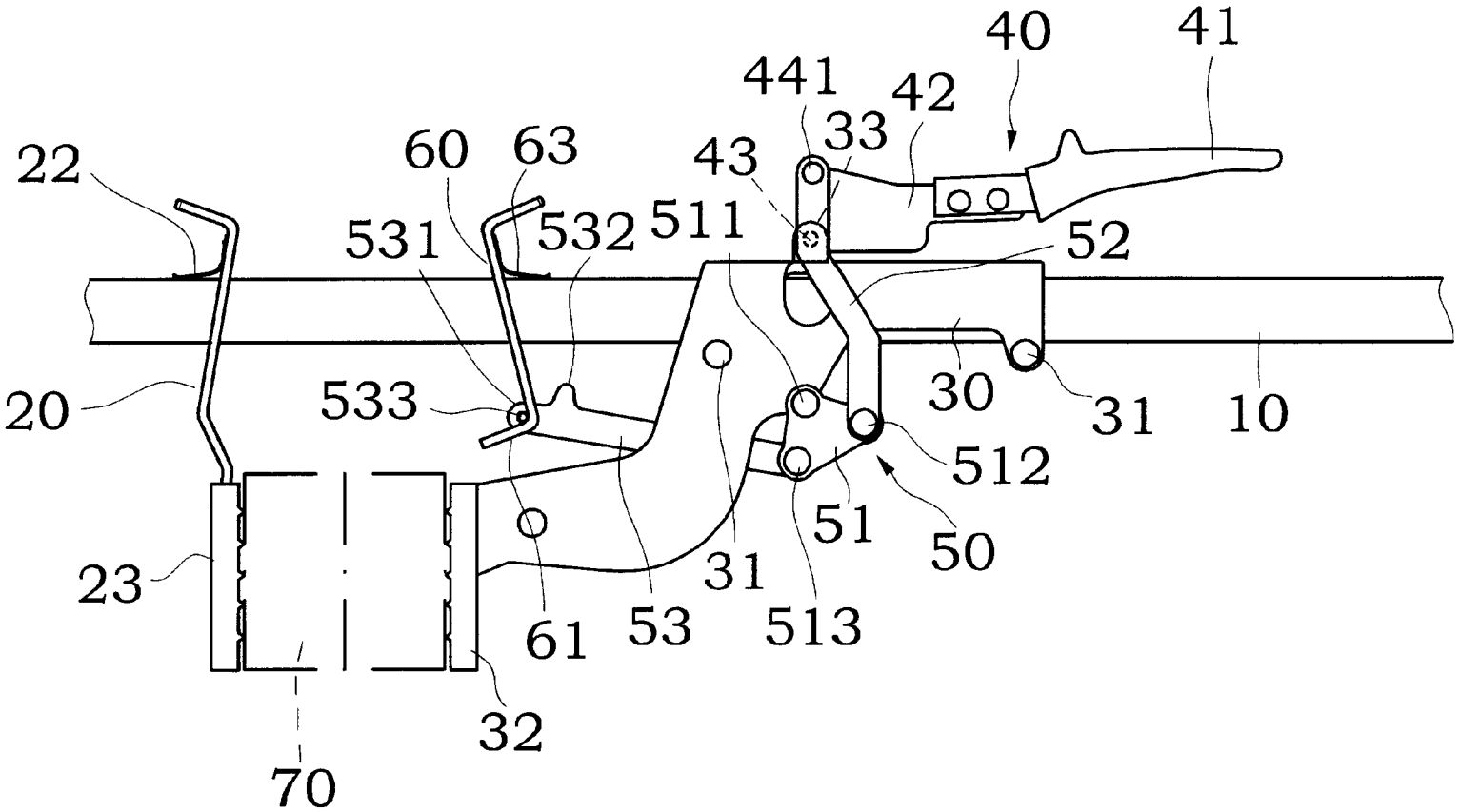
FIG. 2 is a plain view showing the movable clamping plate clamped on the workpiece against the fixed clamping plate according to the present invention.

Referring to FIG. 2, wooden workpiece 70 are arranged together between the clamping face 23 of the fixed clamping plate 20 and the clamping face 32 of the movable clamping plate 30, and then the handgrip 41 of the handle 40 is pressed down to turn the pivot 44 and the blade 42 in clockwise direction, thereby causing the first links 52 to move the triangular coupling plates 51 to further force the second link 53 downwards toward the movable clamping plate 30. The stop rod 533 of the second link 53 is stopped at the angled bottom coupling flange 61 of the stop plate 60 at this time, therefore the stop plate 60 is pulled downwardly backwards to force the top peripheral side of the opening through which the guide bar 10 passes against the teeth of the fine-toothed face 11 of the guide bar 10 to hold down the movable clamping plate 30 in position, thus the clamping faces 23 and 32 are firmly clamped on the workpiece 70.

Figure 3:
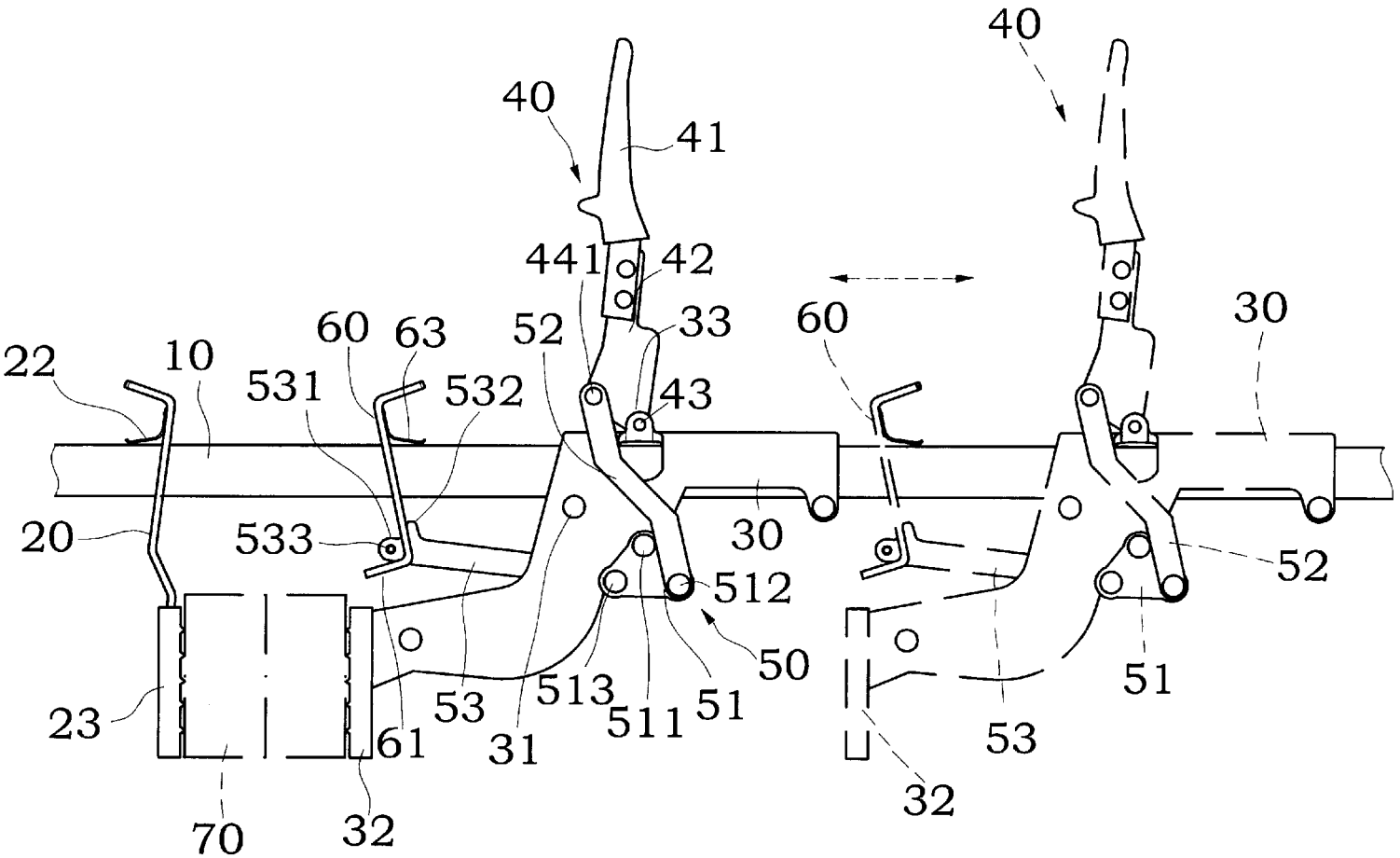
FIG. 3 is a schematic drawing showing the handle turned to the unlocking vertical position, the movable clamping plate moved along the guide bar according to the present invention.

Referring to FIG. 3. when releasing the workpiece 70, the handgrip 41 is lifted, and the pivot 44 with the blade 42 are turned in counter-clockwise direction to move the first links 52 downwards, thereby causing the triangular coupling plates 51 to be turned downwards with the first links 52, and at the same time the second link 53 is forced upwardly forwards by the triangular coupling plates 51 to disengage the transverse stop rod 533 from the angled bottom coupling flange 61 and to push the second fork 532 against the stop plate 60 thereby causing the press tongue 63 to be disengaged from the fine-toothed face 11 of the guide bar 10 for enabling the movable clamping plate 30 to be moved away from the workpiece 70 along the guide bar 10.

Figure 4:
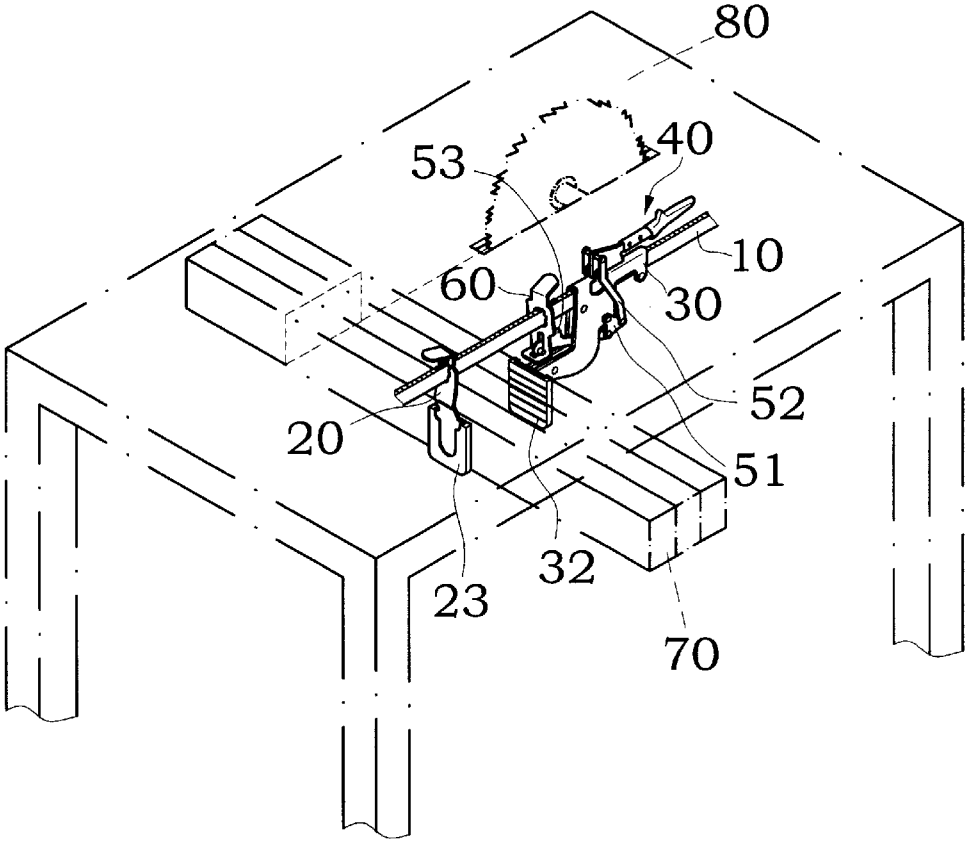
FIG. 4 shows the work clamp clamped on the workpiece and put with the workpiece on a bench saw for cutting.

FIG. 4 shows the work clamp clamped on wooden workpiece 70 and put with wooden workpiece 70 on a bench saw 80 for processing. As indicated above, the operation of the work clamp is so simple. When turning the handle 40 downwards to the horizontal position as shown in FIGS. 1, 2 and 4, the movable clamping plate 30 is forced against the workpiece 70 and locked. On the contrary, when turning the handle 40 upwards from the horizontal position shown in FIGS. 1, 2 and 4 to the vertical position shown in FIG. 3, the movable clamping plate 30 is unlocked and can be moved along the guide bar 10.

A prototype of work clamp has been constructed with the features of FIGS. 1~4. The work clamp functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A work clamp for woodworking machines, comprising:

a guide bar;

a fixed clamping plate fixedly fastened to said guide bar, said fixed clamping plate having a clamping face disposed at a bottom side thereof;

a movable clamping plate mounted on said guide bar and driven to move along said guide bar relative to said fixed clamping plate, said movable clamping plate having a clamping face disposed at a bottom side thereof and facing the clamping face of said fixed clamping plate for clamping workpiece between said fixed clamping plate and said movable clamping plate;

a handle, said handle having a fixed end pivoted to said movable clamping plate and a free end terminating in a handgrip;

a linkage, said linkage comprising two first links, said first links each having a top end pivoted to said handle and a bottom end, two coupling plates bilaterally pivotally coupled between said movable clamping plate and the bottom end of each of said first link, and a second link, said second link having a first end pivoted to said coupling plates and a second end; and a stop plate mounted on said guide bar between said fixed clamping plate and said movable clamping plate, said stop plate having a bottom end coupled to the second end of said second link.

2. The work clamp of claim 1 wherein the free end of said handle terminates in a blade, said blade having a front bottom end pivoted to said movable clamping plate.

3. The work clamp of claim 2 wherein said blade of said handle has a front top end pivoted to the first end of each of said first links.

4. The work clamp of claim 1 wherein the send end of said second link comprises a first fork inserted through a hole on said stop plate, a stop rod fixedly fastened to said first fork and stopped at one side of said stop plate and a second fork stopped at one side of said stop plate opposite to said stop rod.

5. The work clamp of claim 1 wherein said stop plate comprises a press tongue obliquely disposed near a top side thereof and stopped at a top side of said guide bar.

6. The work clamp of claim 1 wherein said guide bar has a fine-toothed face longitudinally disposed at a top side thereof.

7. The work clamp of claim 1 wherein said fixed clamping plate has a through hole, and said guide bar is press-fitted into the through hole of said fixed clamping plate.

8. The work clamp of claim 7 wherein said fixed clamping plate comprises a press tongue obliquely downwardly extended from a top peripheral side of the through hole of said fixed clamping plate and stopped at a top side of said guide bar.

* * * * *